US005684262A

United States Patent [19]

Nakamura et al.

[11] Patent Number: 5,684,262

[45] Date of Patent: Nov. 4, 1997

[54] PITCH-MODIFIED MICROPHONE AND AUDIO REPRODUCING APPARATUS

[75] Inventors: Junichi Nakamura, Chiba; Masakazu Nakamura, Kanagawa, both of Japan

[73] Assignee: Sony Corporation, Tokyo, Japan

[21] Appl. No.: 602,796

[22] PCT Filed: Jul. 27, 1995

[86] PCT No.: PCT/JP95/01500

§ 371 Date: May 23, 1996

§ 102(e) Date: May 23, 1996

[87] PCT Pub. No.: WO96/03740

PCT Pub. Date: Feb. 8, 1996

[30] Foreign Application Priority Data

Jul. 28, 1994 [JP] Japan ..... 6-176775

[51] Int. Cl.[6] ..... G10H 5/00

[52] U.S. Cl. ..... 811/654; 84/657; 84/660

[58] Field of Search ..... 84/610, 616, 619, 84/625, 634, 650, 654, 657, 660

[56] References Cited

U.S. PATENT DOCUMENTS 5,157,215 10/1992 Nakae et al. ..... 84/624

5,278,346 1/1994 Yamaguchi et al. ..... 84/609

5,286,912 2/1994 Yamaguchi ..... 84/616

5,296,643 3/1994 Kuo et al. ..... 84/634 X 5,446,238 8/1995 Koyama et al. ..... 84/669

5,477,003 12/1995 Muraki et al. ..... 84/610

*Primary Examiner*—William M. Shoop, Jr.

*Assistant Examiner*—Jeffrey W. Donels

*Attorney, Agent, or Firm*—Jay H. Maioli

[57] ABSTRACT

An apparatus for playing back a recording medium on which a plurality of accompaniment signals and identification information indicative of respective genres of the accompaniment signals are recorded includes a playback device, at least one tone converter, and first and second mixers. The playback device plays back a recording medium loaded in the apparatus. The tone converter converts an inputted voice signal from a microphone into a voice signal having a tone spaced a given pitch from the tone of the inputted voice signal. The first mixer mixes the voice signal converted by the tone converter with the inputted voice signal, and the second mixer mixes a voice signal outputted from the first mixer with an accompaniment signal outputted from the playback device.

9 Claims, 3 Drawing Sheets

PITCH-MODIFIED MICROPHONE AND AUDIO REPRODUCING APPARATUS

TECHNICAL FIELD

The present invention relates to an audio reproducing apparatus, and more particularly to an audio reproducing apparatus for mixing and outputting a reproduced accompaniment signal and an inputted audio signal.

BACKGROUND ART

Heretofore, there have been developed various music reproducing apparatus called a "karaoke" system which outputs a musical accompaniment signal reproduced from a compact disk or a video disc, picks up and adds a voice signal produced by a singer who sings to the reproduced accompaniment, to the musical accompaniment signal, and outputs the sum signal from a loudspeaker.

The "karaoke" system generally has a built-in reverberation adding device for adding a reverberation to the voice signal, picked up by a microphone, from the singer and adding the resultant audio signal to the musical accompaniment signal. The added echo produces an effect which makes the singing voice reproduced from the loudspeaker sound as if the singer sang very well.

There are demands for more sophisticated audio effects to be added to audio signals. However, no highly sophisticated processing has been effected on audio signals because singers' voice signals picked up by microphones need to be processed on a real-time basis and outputted from loudspeakers.

DISCLOSURE OF THE INVENTION

In view of the foregoing demands, it is an object of the present invention to provide an audio reproducing apparatus capable of imparting sophisticated audio effects to voice signals.

According to a first aspect of the invention, an audio reproducing apparatus comprises at least one tone converting means for converting an inputted voice signal into a voice signal having a tone spaced a given pitch from the tone of the inputted voice signal, first mixing means for mixing the voice signal converted by the tone converting means with the inputted voce signal, and second mixing means for mixing a voice signal outputted from the first mixing means with an accompaniment signal. With this arrangement, a voice signal having a tone spaced a given pitch from the tone of the inputted voice signal is added to the inputted voice signal, and they are mixed with an accompaniment signal. The audio reproducing apparatus therefore imparts a so-called unison effect to the inputted voice signal, thereby producing a sophisticated audio effect.

According to a second aspect of the invention, the audio reproducing apparatus according to the first aspect of the invention further comprises sound level detecting means for detecting a sound level of the inputted voce signal, and control means for controlling the tone converting means based on a detected result from the sound level detecting means. With this arrangement, the audio reproducing apparatus carries out appropriate tone conversion depending on the sound level.

According to a third aspect of the invention, the audio reproducing apparatus according to the first aspect of the invention further comprises a feedback loop for feeding the voice signal outputted from the first mixing means back to an input terminal of the tone converting means. With this arrangement, the audio reproducing apparatus can carry out tone conversion in a plurality of steps for thereby producing a more sophisticated audio effect.

According to a fourth aspect of the invention, the audio reproducing apparatus according to the first aspect of the invention further comprises control means for controlling the tone converting means based on a genre of the accompaniment signal. With this arrangement, the audio reproducing apparatus can establish a pitch for appropriate tone conversion depending on the genre of the accompaniment signal, for imparting a sound that is effectively converted in tone.

According to a fifth aspect of the invention, an audio reproducing apparatus comprises playback means for playing back a recording medium on which a plurality of accompaniment signals and identification information indicative of respective genres of the accompaniment signals are recorded, at least one tone converting means for converting an inputted voice signal from a microphone into a voice signal having a tone spaced a given pitch from the tone of the inputted voice signal, first mixing means for mixing the voice signal converted by the tone converting means with the inputted voce signal, and second mixing means for mixing a voice signal outputted from the first mixing means with an accompaniment signal outputted from the playback means. With this arrangement, a voice signal having a tone spaced a given pitch from the tone of the inputted voice signal from the microphone is added to the inputted voice signal, and they are mixed with an accompaniment signal from the playback means. The audio reproducing apparatus can reproduce the voice of a singer in a plurality of sets of tones when the singer is singing alone using the microphone. The audio reproducing apparatus therefore imparts a so-called unison effect to the inputted voice signal, thereby producing a sophisticated audio effect as if a plurality of people were singing.

According to a sixth aspect of the invention, in the audio reproducing apparatus according to the fifth aspect of the invention, the tone converting means generates a signal having a tone which is a given pitch lower than the tone of the inputted voice signal from the microphone. With this arrangement, the audio reproducing apparatus imparts a voice signal that has well been converted in tone.

According to a seventh aspect of the invention, the audio reproducing apparatus according to the fifth aspect of the invention further comprises sound level detecting means for detecting a sound level of the inputted voice signal from the microphone, and control means for controlling the tone converting means based on a detected result from the sound level detecting means. With this arrangement, the audio reproducing apparatus carries out appropriate tone conversion depending on the sound level inputted from the microphone.

According to an eighth aspect of the invention, the audio reproducing apparatus according to the fifth aspect of the invention further comprises determining means for determining the identification information reproduced from the recording medium by the playback means, and control means for controlling the tone converting means based on a determined result from the determining means. With this arrangement, the audio reproducing apparatus carries out appropriate tone conversion depending on the type of the accompaniment signal based on the identification information on the recording medium.

According to a ninth aspect of the invention, the audio reproducing apparatus according to the fifth aspect of the invention further comprises a feedback loop for feeding the voice signal outputted from the first mixing means back to an input terminal of the tone converting means. With this arrangement, the audio reproducing apparatus can carry out tone conversion in a plurality of steps for thereby producing a more sophisticated audio effect.

According to a tenth aspect of the invention, the audio reproducing apparatus according to the fifth aspect of the invention further comprises a plurality of tone converting means each for converting an inputted voice signal from a microphone into a voice signal having a tone spaced a given pitch from the tone of the inputted voice signal, and an output signal from the tone converting means and output signals from the plurality of tone converting means are supplied to the first mixing means. With this arrangement, the audio reproducing apparatus imparts a plurality of voice signals that have been converted in tone for thereby producing a more sophisticated audio effect.

BEST MODE FOR CARRYING OUT THE INVENTION

Audio reproducing apparatus according to the present invention will hereinafter be described in detail below with reference to the drawings.

Figure 1:
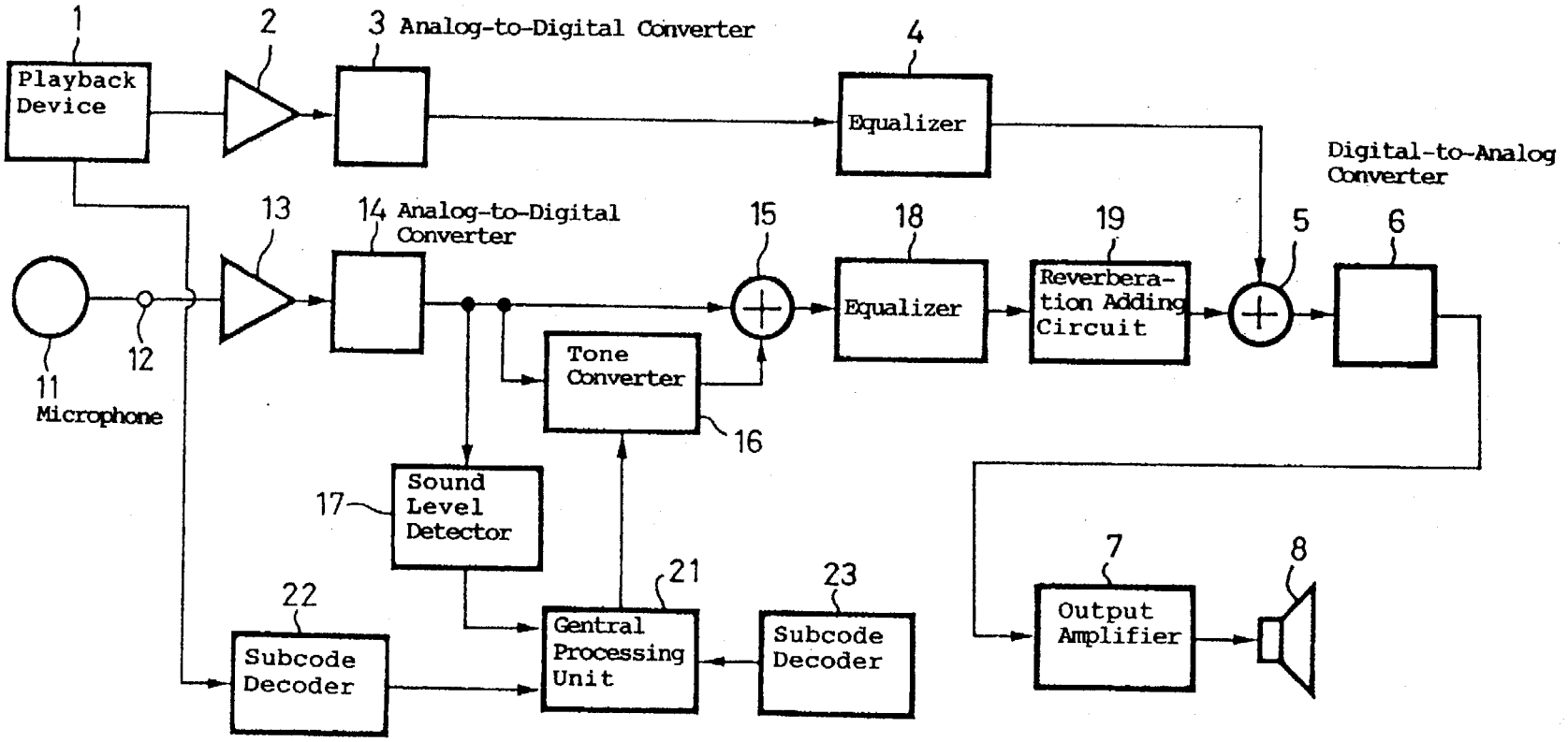
FIG. 1 is a block diagram of an audio reproducing apparatus according to an embodiment of the present invention.

FIG. 1 shows in block form an audio reproducing apparatus according to an embodiment of the present invention. In this embodiment, the present invention is applied to a reproducing system called a "karaoke" system. The reproducing system has a playback device 1 for playing back a recording medium such as a compact disc or the like on which a "karaoke" accompaniment has been recorded. The playback device 1 supplies an accompaniment signal (an audio signal) produced by playing back the recording medium to a line amplifier 2. If subcode data indicative of the genre of an accompaniment signal is recorded together with the accompaniment signal as an audio signal on the recording medium, then the playback device 1 also outputs the subcode data. Specifically, if a compact disc is used as the recording medium, the subcode data indicating the genre of a music piece is recorded on the compact disc using any one of subcodes R~W among subcodes P, Q, R, . . . W which are available for the compact disc.

The accompaniment signal as an audio signal supplied to the line amplifier 2 is amplified by the line amplifier 2, and thereafter supplied to an analog-to-digital converter 3, which converts the accompaniment signal into a digital audio signal. The digital audio signal is supplied to an equalizer 4, which equalizes the digital audio signal and supplies the equalized digital audio signal to a mixer 5.

A microphone 11 connected to a microphone connection terminal 12 picks up a voice signal produced by a singer, and supplies the voice signal through a microphone amplifier 13 to an analog-to-digital converter 14. The analog-to-digital converter 14 converts the voice signal into a digital audio signal, and supplies the digital audio signal to a mixer 15, a tone converter 16, and a sound level detector 17.

The tone converter 16 serves to convert the digital audio signal supplied from the analog-to-digital converter 14 into a digital audio signal having a tone which is a given pitch lower than the tone of the supplied digital audio signal. In this embodiment, the tone converter 16 converts the supplied digital audio signal into a digital audio signal that is lower in pitch by a value preset in the range of from 20 percent to 50 percent. The value by which the tone converter 16 converts the supplied digital audio signal is selected under the control of a central processing unit (CPU) 21 which comprises a microcomputer for controlling various components of the audio reproducing apparatus. A process of selecting the value by which the tone converter 16 converts the supplied digital audio signal will be described later on.

The digital audio signal produced by the tone converter 16 is supplied to the mixer 15, which adds the supplied digital audio signal to the digital audio signal which is not converted in tone that is supplied from the analog-to-digital converter 14. The sum digital audio signal produced by the mixer 15 is supplied to an equalizer 18. After being equalized by the equalizer 18, the digital audio signal is supplied to a reverberation adding circuit 19 that adds a reverberation called an echo to the supplied digital audio signal. The digital audio signal with the added reverberation is supplied to the mixer 5.

The mixer 5 mixes the digital audio signal based on the singer's voice signal picked up by the microphone 11 with the accompaniment signal reproduced by the playback device 1, and supplies the mixed digital audio signal to a digital-to-analog converter 6, which converts the supplied digital audio signal into an analog audio signal. The analog audio signal produced by the digital-to-analog converter 6 is amplified by an output amplifier 7, and then supplied to a loudspeaker 8. The loudspeaker 8 radiates a sound composed of a mixture of the accompaniment reproduced by the playback device 1, the singer's voice inputted from the microphone 11, and the echo added to the singer's voice.

The audio signal reproduced by the playback device 1 is generally a 2-channel stereophonic audio signal, and the reproducing system from the playback device 1 to the loudspeaker 8 is of a 2-channel configuration. For the sake of brevity, however, only one channel of the reproducing system is illustrated in FIG. 1.

The process of controlling the tone converter 16 with the central processing unit 21 will be described below. The central processing unit 21 is supplied with data representing a voice signal level detected by the sound level detector 17 and also with data which is decoded from subcode data from the playback device 1 by a subcode decoder 22. To the central processing unit 21, there are connected a plurality of control keys 23 which can be operated by the user to indicate and input various control operations on the audio reproducing apparatus. When the user operates one of the control keys 23 to indicate and input the generation of a unison effect, the central processing unit 21 controls the tone converter 16 to output an audio signal with a converted tone. The central processing unit 21 has three modes for controlling the conversion process of the tone converter 16. These three modes include a fixed mode for controlling the tone controller 16 to convert the supplied digital audio signal into a digital audio signal that is a preset pitch lower than the supplied digital audio signal, a sound level control mode for controlling the tone controller 16 to convert the supplied digital audio signal depending on the level of the voice signal picked up by the microphone 11, and a genre-dependent control mode for controlling the tone controller 16 to convert the supplied digital audio signal depending on the genre of the music piece that is reproduced.

When one of the control keys 23 for switching between the three modes is operated by the user to select the fixed mode, the central processing unit 21 controls the tone converter 16 to convert the supplied digital audio signal into a digital audio signal that is lower in pitch by a preset value in the range of from 20 percent to 50 percent. In the fixed mode, therefore, a sound which is a given frequency lower than the audio signal based on the singing voice of the singer picked up by the microphone 11 is added to the audio signal, and they are reproduced together with the accompaniment. Accordingly, the audio reproducing system generates a unison effect as if two singers were singing though actually one singer is singing. The value by which the tone converter 16 converts the supplied digital audio signal may be established using one of the control keys 23.

Figure 2A:
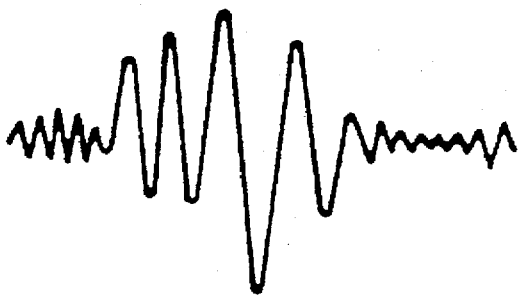
FIGS. 2A, 2B, and 2C are timing charts showing a tone control process of the audio reproducing apparatus.
Figure 2B:
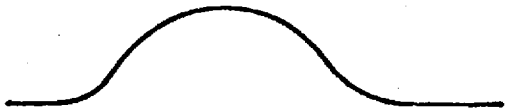
Figure 2C:
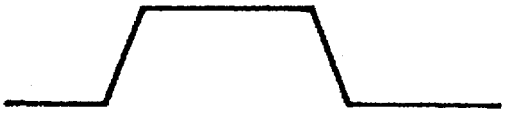

When the control key 23 for switching between the three modes is operated by the user to select the sound level control mode, the central processing unit 21 controls the tone converter 16 to continuously vary the quantity of tone conversion depending on the voice signal level detected by the sound level detector 17. For example, if the voice signal picked up by the microphone 11 has a waveform as shown in FIG. 2A, then the sound level detector 17 detects the level of the voice signal corresponding to the envelope thereof as shown in FIG. 2B (actually, the sound level detector 17 detects the level of the voice signal based on bit data since the voice signal supplied thereto is a digital signal), and the central processing unit 21 varies a change in the tone in the tone converter 16 as shown in FIG. 2C (the waveform shown in FIG. 2C represents the magnitude of the change in the tone). In this embodiment, when the level of the voice signal is large, the central processing unit 21 controls the tone converter 16 to convert the supplied digital audio signal into a digital audio signal that is lower in pitch by 50 percent. As the level of the voice signal picked up by the microphone 11 decreases, the central processing unit 21 varies the change in the tone progressively down to 20 percent. Therefore, the central processing unit 21 continuously varies the change in the tone between 50 percent and 20 percent depending on the voice signal level.

In the sound level control mode, therefore, when the level of the voice signal picked up by the microphone 11, i.e., the level of the voice uttered by the singer, is small, a sound which is a small frequency lower than the audio signal based on the singing voice of the singer is added to the audio signal, and they are reproduced together with the accompaniment. As the level of the voice signal increases, the added sound has a frequency that is farther from the frequency of the uttered voice. Consequently, the added sound frequency is processed depending on the level of the voice signal. The principles of the sound level control mode are as follows: When the singing voice of the singer is small, i.e., when the level of the voice signal is low, the sound added to the singing voice of the singer can easily be distinguished even if its frequency is close to the frequency of the singing voice of the singer, and the unison effect generated by the audio reproducing apparatus can be confirmed based on the sound radiated from the loudspeaker. When the singing voice of the singer is large, i.e., when the level of the voice signal is high, the sound added to the singing voice of the singer is masked by the singing voice of the singer due to the auditory masking effect, and cannot easily be distinguished if its frequency is close to the frequency of the singing voice of the singer. In the sound level control mode, when the level of the voice signal is high, the sound added to the singing voice of the singer has a frequency that is spaced a relatively wide tone from the frequency of the singing voice of the singer, and hence can easily be heard without being masked by the singing voice of the singer. As a result, the unison effect generated by the audio reproducing apparatus can also be confirmed based on the sound radiated from the loudspeaker. As described above, the sound level control mode adds, to the singing voice of the singer, a sound that has well been converted in tone irrespective of the magnitude of the level of the voice signal picked up by the microphone 11, i.e., the magnitude of the singing voice of the singer.

When the control key 23 for switching between the three modes is operated by the user to select the genre-depending control mode, the subcode decoder 22 decodes subcode data, e.g., the data of at least one of subcodes R~W for a compact disc, recorded on the recording medium with respect to a music piece that is being reproduced by the playback device 1. The subcode decoder 22 supplies the decoded data, representing the genre of the music piece reproduced by the playback device 1, to the central processing unit 21, which then determines the genre of the music piece based on the supplied decoded data. The central processing unit 21 controls the tone converter 16 to vary the quantity of tone conversion between 20 percent and 50 percent. For example, if the decoded data representing the genre of the music piece, i.e., if the music piece reproduced by the playback device 1 is of a relatively quiet type such as a Japanese popular song ("enka") or a ballad, then the central processing unit 21 sets the quantity of tone conversion to a relatively small value such as of 20 cents. If the decoded data indicates the genre of the music piece as a relatively loud kind such as pops, rock and roll, or jazz, then the central processing unit 21 sets the quantity of tone conversion to a relatively large value such as of 50 percent. The tone converter 16 is thus controlled to convert the tone of a sound depending on the genre of the music piece, and the sound thus converted in tone is added to the singing voice of the singer.

The sound level control mode which depends on the magnitude of the singing voice of the singer, i.e., the level of the voice signal, and the genre-depending control mode which depends on the music piece being reproduced may be carried out at the same time. For example, the central processing unit 21 may determine the basic quantity of tone conversion in the tone converter 16 depending on the genre of the music piece, and may vary the quantity of tone conversion in the tone converter 16 from the basic quantity of tone conversion by about 10 percent depending on the level of the voice signal picked up by the microphone 11.

As described above, when the audio reproducing apparatus according to this embodiment operates to reproduce a music piece, a sound that is spaced a given pitch from the inputted singing voice of the singer is automatically added to the singing voice of the singer. Therefore, the audio reproducing apparatus can produce a unison effect as if two singers were singing through actually one singer is singing. Even if the singer sings with unstable tones, the audio reproducing apparatus reproduces the singing voice of the singer in a plurality of sets of tones which may highly possibly contain tones matching the accompaniment. Therefore, the audio reproducing apparatus can output a reproduced sound in tones matching the accompaniment which are comfortable to listeners. When only a chorus is reproduced together with an accompaniment, the singer is not made dependent on the chorus, and the singing voice of the singer can well be reproduced.

In this embodiment, the reverberation is also added by the reverberation adding circuit 19 to the singing voice of the singer to which the sound spaced a given pitch therefrom is added. Therefore, the audio reproducing apparatus can reproduce a more effective, comfortable sound.

While in the above embodiment a sound which is lower in frequency than the singing voice of the singer is generated by the tone converter 16 and then added to the audio signal, a sound which is higher in frequency than the singing voice of the singer is generated by the tone converter 16 and then added to the audio signal.

Figure 3:
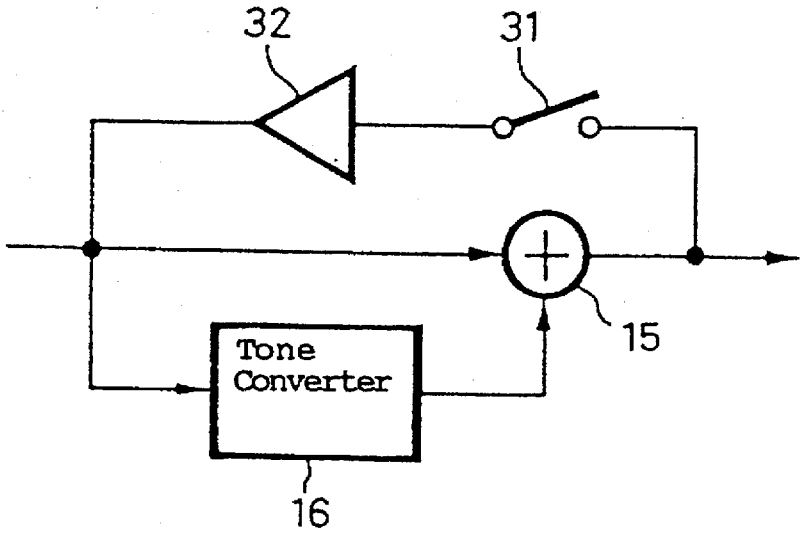
FIG. 3 is a block diagram of a portion of an audio reproducing apparatus according to another embodiment of the present invention.

In the above embodiment, the sound converted by the tone converter 16 is simply added to the singing voice of the singer. However, as shown in FIG. 3, the sum audio signal produced by the mixer 15 may be fed back through a switch 31 and an amplifier 32 to an input terminal of the tone converter 16. When the switch 31 is closed, making a loop circuit, another tone-converted sound is successively added to the sound that has been converted in tone by the tone converter 16. In this arrangement, a plurality of tone-converted sounds may be added depending on the feedback condition that is established by the gain of the amplifier 32.

Figure 4:
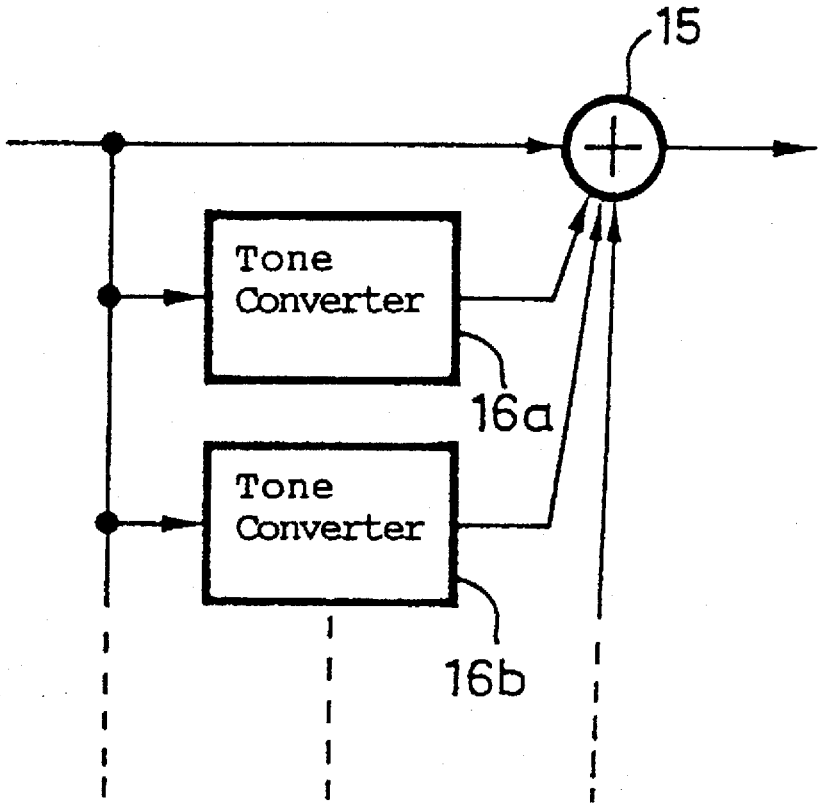
FIG. 4 is a block diagram of a portion of an audio reproducing apparatus according to still another embodiment of the present invention.

The audio reproducing apparatus may have a plurality of tone converters. For example, as shown in FIG. 4, a plurality of tone converters 16*a*, 16*b*, . . . may produce respective tone-converted sounds, which are added to each other and the voice signal from the singer by the mixer 15. The quantities of tone conversion in the respective tone converters 16*a*, 16*b*, . . . may be slightly varied for more effective sound reproduction. The tone converters 16*a*, 16*b*, . . . may be arranged to vary the respective quantities of tone conversion successively by 10 percent such that the tone converter 16*a* converts the supplied audio signal into an audio signal that is 20 percent lower than the supplied audio signal, the tone converter 16*b* converts the supplied audio signal into an audio signal that is 30 percent lower than the supplied audio signal, the tone converter 16*c* converts the supplied audio signal into an audio signal that is 40 percent lower than the supplied audio signal, and the tone converter 16*d* converts the supplied audio signal into an audio signal that is 50 percent lower than the supplied audio signal. Whereas the audio reproducing apparatus shown in FIG. 1 generates an effect as if two singers were singing, the audio reproducing apparatus shown in FIG. 4 can therefore generate an effect as if more people were singing.

The plurality of tone converters shown in FIG. 4 may include a tone converter for converting the supplied audio signal into an audio signal which is a certain percent higher than the supplied audio signal and a tone converter for converting the supplied audio signal into an audio signal which is a certain percent lower than the supplied audio signal, so that sounds higher and lower in frequency of the singer's voice may be added to the singer's voice.

The quantities of tone conversion illustrated in the above embodiments are given by way of example only, and other quantities of tone conversion may of course be employed.

The recording medium may be a disc-shaped recording medium other than a compact disc, e.g., an optical video disc or a video disc of the type for detecting an electrostatic capacitance for reproduction, or a tape-like recording medium. The present invention is not limited to the above embodiments, but may be modified in various ways without departing from the scope of the invention.

The audio reproducing apparatus according to the present invention adds a sound that is spaced a certain pitch from the inputted voice signal to the inputted voice signal, and mixes the voice signal with the added sound with a musical signal representing an accompaniment or the like. Therefore, the audio reproducing apparatus can reproduce the singing voice in a plurality of sets of tones even when the singer is singing alone. The audio reproducing apparatus can thus simply generate an effect as if a plurality of people were singing without any special control operation. Even if the singer sings with unstable tones, the audio reproducing apparatus reproduces the singing voice of the singer in a plurality of sets of tones which may highly possibly contain tones matching the accompaniment. Therefore, the audio reproducing apparatus can output a reproduced sound in tones matching the accompaniment which are comfortable to listeners. When only a chorus is reproduced together with an accompaniment, the singer is not made dependent on the chorus, and the singing voice of the singer can well be reproduced.

We claim:

1. An audio reproducing apparatus comprising:

at least one tone converting means for converting an inputted voice signal into a voice signal having a tone spaced a predetermined pitch difference from a tone of the inputted voice signal;

first mixing means for mixing the voice signal converted by said tone converting means with said inputted voice signal;

means for producing an accompaniment signal;

second mixing means for mixing a voice signal outputted from said first mixing means with the accompaniment signal;

sound level detecting means for detecting a sound level of the inputted voice signal; and control means for controlling said tone converting means based on a detected result from said sound level detecting means, whereby the predetermined pitch difference is larger at high sound levels and smaller at low sound levels.

2. An audio reproducing apparatus according to claim 1 further comprising a feedback loop for feeding the voice signal outputted from said first mixing means back to an input terminal of said tone converting means.

3. An audio reproducing apparatus according to claim 1 further comprising control means for controlling said tone converting means based on a genre of the accompaniment signal.

4. An audio reproducing apparatus comprising:

playback means for playing back a recording medium on which a plurality of accompaniment signals and identification information indicative of respective genres of the accompaniment signals are recorded;

at least one tone converting means responsive to said identification information for converting an inputted voice signal from a microphone into a voice signal having a tone spaced a given pitch from the tone of the inputted voice signal;

first mixing means for mixing the voice signal converted by said tone converting means with said inputted voice signal; and second mixing means for mixing a voice signal outputted from said first mixing means with an accompaniment signal corresponding to said identification information and outputted from said playback means.

5. An audio reproducing apparatus according o claim 4 wherein said tone converting means generates a signal having atone which is a given pitch lower than the tone of the inputted voice signal from the microphone.

6. An audio reproducing apparatus according to claim 4 further comprising sound level detecting means for detecting a sound level of the inputted voice signal from the microphone, and control means for controlling said tone converting means based on a detected result from said sound level detecting means.

7. An audio reproducing apparatus according to claim 4 further comprising determining means for determining the identification information reproduced from said recording medium by said playback means, and control means for controlling said tone converting means based on a determined result from said determining means.

8. An audio reproducing apparatus according to claim 4 further comprising a feedback loop for feeding the voice signal outputted from said first mixing means back to an input terminal of said tone converting means.

9. An audio reproducing apparatus according to claim 4 further comprising a plurality of tone converting means each for converting an inputted voice signal from a microphone into a voice signal having a tone spaced a given pitch from the tone of the inputted voice signal, wherein an output signal form said tone converting means and output signals from said plurality of tone converting means are supplied to said first mixing means.

* * * * *